US008723896B2

(12) United States Patent
Huang

(10) Patent No.: US 8,723,896 B2
(45) Date of Patent: May 13, 2014

(54) DRIVER IC, PANEL DRIVING SYSTEM, AND PANEL DRIVING METHOD

(75) Inventor: Li-Chun Huang, Taichung County (TW)

(73) Assignee: Novatek Microelectronics Corp., Hsinchu (TW)

( * ) Notice: Subject to any disclaimer, the term of this patent is extended or adjusted under 35 U.S.C. 154(b) by 236 days.

(21) Appl. No.: 13/076,432

(22) Filed: Mar. 31, 2011

(65) Prior Publication Data

US 2011/0304594 A1 Dec. 15, 2011

(30) Foreign Application Priority Data

Jun. 14, 2010 (TW) ..... 99119299 A

(51) Int. Cl.

| | |
|---|---|
| ***G09G 5/10*** | (2006.01) |
| ***G09G 3/30*** | (2006.01) |
| ***G09G 3/32*** | (2006.01) |

(52) U.S. Cl.

USPC ..... 345/690; 345/76; 345/98

(58) Field of Classification Search

USPC ..... 345/76, 98, 204, 690, 87, 211, 100, 55, 345/77, 92, 544, 545, 556; 257/72, 257/E27.111, 59, E21.413, E21.134, 257/E29.293, E29.278, E33.053, 40, 257/E29.297, 88; 438/149, 166, 151; 365/230.03, 230.06; 315/169.3, 169.2; 341/144; 313/506; 455/566

See application file for complete search history.

(56) References Cited

U.S. PATENT DOCUMENTS

| | | | | |
|---|---|---|---|---|
| 2002/0036604 | A1* | 3/2002 | Yamazaki et al. | 345/76 |
| 2005/0057482 | A1 | 3/2005 | Youngblood et al. | |
| 2007/0080905 | A1* | 4/2007 | Takahara | 345/76 |
| 2007/0139340 | A1* | 6/2007 | Lin et al. | 345/98 |
| 2009/0109247 | A1* | 4/2009 | Kimura | 345/690 |

FOREIGN PATENT DOCUMENTS

| | | |
|---|---|---|
| CN | 1350279 | 5/2002 |
| CN | 1664910 | 9/2005 |
| CN | 101174037 | 5/2008 |
| CN | 101202028 | 6/2008 |
| CN | 101604500 | 12/2009 |
| CN | 101699556 | 4/2010 |
| TW | 200424995 | 11/2004 |
| TW | I298470 | 7/2008 |
| TW | 200926136 | 6/2009 |

OTHER PUBLICATIONS

"Office Action of Taiwan Counterpart Application", issued on Jul. 18, 2013, p. 1-p. 15.

"First Office Action of China Counterpart Application", issued on Jul. 26, 2012, p. 1-p. 8.

"Office Action of Taiwan Counterpart Application", issued on Jan. 7, 2014, p. 1-p. 4, in which the listed references were cited.

* cited by examiner

*Primary Examiner* — Quan-Zhen Wang
*Assistant Examiner* — Michael J Eurice
(74) *Attorney, Agent, or Firm* — Jianq Chyun IP Office

(57) ABSTRACT

A panel driving system including a pixel panel and a driver IC is provided. The pixel panel includes a plurality of data lines and a plurality of pixels, wherein each of the data lines includes a switch. The driver IC drives the pixel panel according to a programmable burning code, wherein the programmable burning code is burnt into the driver IC according to a user information. Accordingly, the panel driving system can adaptively adjust its driving signals to satisfy user requirements according to the programmable burning code. In addition, a panel driving method is also provided.

18 Claims, 6 Drawing Sheets

1 Dot inversion

| Odd frame | R | G | B | R | G | B | R | G | B |
|---|---|---|---|---|---|---|---|---|---|
| Line 1 | + | − | + | − | + | − | + | − | + |
| Line 2 | − | + | − | + | − | + | − | + | − |
| Line 3 | + | − | + | − | + | − | + | − | + |
| Line 4 | − | + | − | + | − | + | − | + | − |
| Line 5 | + | − | + | − | + | − | + | − | + |
| ⋮ | | | | | ⋮ | | | | |
| Line (538) | − | + | − | + | − | + | − | + | − |
| Line (539) | + | − | + | − | + | − | + | − | + |
| Line (540) | − | + | − | + | − | + | − | + | − |

| Even frame | R | G | B | R | G | B | R | G | B |
|---|---|---|---|---|---|---|---|---|---|
| Line 1 | − | + | − | + | − | + | − | + | − |
| Line 2 | + | − | + | − | + | − | + | − | + |
| Line 3 | − | + | − | + | − | + | − | + | − |
| Line 4 | + | − | + | − | + | − | + | − | + |
| Line 5 | − | + | − | + | − | + | − | + | − |
| ⋮ | | | | | ⋮ | | | | |
| Line (538) | + | − | + | − | + | − | + | − | + |
| Line (539) | − | + | − | + | − | + | − | + | − |
| Line (540) | + | − | + | − | + | − | + | − | + |

1+2 Dot inversion

| Odd frame | R | G | B | R | G | B | R | G | B |
|---|---|---|---|---|---|---|---|---|---|
| Line 1 | + | − | + | − | + | − | + | − | + |
| Line 2 | − | + | − | + | − | + | − | + | − |
| Line 3 | − | + | − | + | − | + | − | + | − |
| Line 4 | + | − | + | − | + | − | + | − | + |
| Line 5 | + | − | + | − | + | − | + | − | + |
| ⋮ | | | | | ⋮ | | | | |
| Line (538) | − | + | − | + | − | + | − | + | − |
| Line (539) | − | + | − | + | − | + | − | + | − |
| Line (540) | + | − | + | − | + | − | + | − | + |

| Even frame | R | G | B | R | G | B | R | G | B |
|---|---|---|---|---|---|---|---|---|---|
| Line 1 | − | + | − | + | − | + | − | + | − |
| Line 2 | + | − | + | − | + | − | + | − | + |
| Line 4 | + | − | + | − | + | − | + | − | + |
| Line 3 | − | + | − | + | − | + | − | + | − |
| Line 5 | − | + | − | + | − | + | − | + | − |
| ⋮ | | | | | ⋮ | | | | |
| Line (538) | + | − | + | − | + | − | + | − | + |
| Line (539) | + | − | + | − | + | − | + | − | + |
| Line (540) | − | + | − | + | − | + | − | + | − |

1+8 Dot inversion

| Odd frame | R | G | B | R | G | B | R | G | B |
|---|---|---|---|---|---|---|---|---|---|
| Line 1 | + | − | + | − | + | − | + | − | + |
| Line 2~9 | − | + | − | + | − | + | − | + | − |
| Line 10~17 | + | − | + | − | + | − | + | − | + |
| Line 18~25 | − | + | − | + | − | + | − | + | − |
| Line 25~33 | + | − | + | − | + | − | + | − | + |
| ⋮ | | | | | ⋮ | | | | |
| Line (522~529) | + | − | + | − | + | − | + | − | + |
| Line (530~537) | − | + | − | + | − | + | − | + | − |
| Line (538~540) | + | − | + | − | + | − | + | − | + |

| Even frame | R | G | B | R | G | B | R | G | B |
|---|---|---|---|---|---|---|---|---|---|
| Line 1 | − | + | − | + | − | + | − | + | − |
| Line 2~9 | + | − | + | − | + | − | + | − | + |
| Line 10~17 | − | + | − | + | − | + | − | + | − |
| Line 18~25 | + | − | + | − | + | − | + | − | + |
| Line 25~33 | − | + | − | + | − | + | − | + | − |
| ⋮ | | | | | ⋮ | | | | |
| Line (522~529) | − | + | − | + | − | + | − | + | − |
| Line (530~537) | + | − | + | − | + | − | + | − | + |
| Line (538~540) | − | + | − | + | − | + | − | + | − |

Column inversion

| Odd frame | R | G | B | R | G | B | R | G | B |
|---|---|---|---|---|---|---|---|---|---|
| Line 1 | + | − | + | − | + | − | + | − | + |
| Line 2 | + | − | + | − | + | − | + | − | + |
| Line 3 | + | − | + | − | + | − | + | − | + |
| Line 4 | + | − | + | − | + | − | + | − | + |
| Line 5 | + | − | + | − | + | − | + | − | + |
| ⋮ | | | | | ⋮ | | | | |
| Line (538) | + | − | + | − | + | − | + | − | + |
| Line (539) | + | − | + | − | + | − | + | − | + |
| Line (540) | + | − | + | − | + | − | + | − | + |

| Even frame | R | G | B | R | G | B | R | G | B |
|---|---|---|---|---|---|---|---|---|---|
| Line 1 | − | + | − | + | − | + | − | + | − |
| Line 2 | − | + | − | + | − | + | − | + | − |
| Line 3 | − | + | − | + | − | + | − | + | − |
| Line 4 | − | + | − | + | − | + | − | + | − |
| Line 5 | − | + | − | + | − | + | − | + | − |
| ⋮ | | | | | ⋮ | | | | |
| Line (538) | − | + | − | + | − | + | − | + | − |
| Line (539) | − | + | − | + | − | + | − | + | − |
| Line (540) | − | + | − | + | − | + | − | + | − |

FIG. 4

DRIVER IC, PANEL DRIVING SYSTEM, AND PANEL DRIVING METHOD

CROSS-REFERENCE TO RELATED APPLICATION

This application claims the priority benefit of Taiwan application serial no. 99119299, filed Jun. 14, 2010. The entirety of the above-mentioned patent application is hereby incorporated by reference herein and made a part of this specification.

BACKGROUND OF THE INVENTION

1. Field of the Invention

The invention generally relates to a panel driving system and a method thereof, and more particularly, to a low-temperature polysilicon (LTPS) panel driving system and a method thereof.

2. Description of Related Art

The low-temperature polysilicon (LTPS) manufacturing process is applied to manufacture next-generation thin film transistor liquid crystal displays (TFT LCDs). Compared to a conventional amorphous display panel, a display panel manufactured through the LTPS manufacturing process offers shorter response time, higher brightness, and higher resolution.

Thus, the application of LTPS panels on active-matrix liquid crystal displays (AMLCDs) and active-matrix organic light emitting diodes (AMOLEDs) has been brought into focus. In a LCD with a LTPS panel, a pixel circuit and a driving circuit are realized on a single glass substrate by using polysilicon TFTs so that the system cost is reduced. Presently, AMLCDs with LTPS panels have been applied to many portable systems, such as cell phones, digital cameras, and notebook computers.

However, the control signals and drive timing of a source driver in a conventional driver IC of a LTPS panel are usually designed according to specifications provided by a user. Accordingly, different driving techniques are usually adopted with respect to different LTPS panels. A driver IC designed according to the specification provided by a specific user cannot be applied to LTPS panels of other users. Namely, if a driver IC needs to support two different types of LTPS panels, two corresponding drive timings have to be respectively designed in the driver IC. If subsequently a LTPS panel of another user is to be supported, the driver IC has to be redesigned based on the specification provided by this user, which is very cost- and time-consuming.

SUMMARY OF THE INVENTION

Accordingly, the invention is directed to a panel driving system that can adaptively adjust its driving signals to satisfy user requirements according to a programmable burning code.

The invention is also directed to a driver IC that can adaptively adjust its driving signals to satisfy user requirements according to a programmable burning code.

The invention is further directed to a panel driving method that can adaptively adjust its driving signals to satisfy user requirements according to a programmable burning code.

The invention provides a panel driving system including a pixel panel and a driver IC. The pixel panel includes a plurality of data lines and a plurality of pixels, wherein each of the data lines includes a switch. The driver IC drives the pixel panel according to a programmable burning code, wherein the programmable burning code is burnt into the driver IC according to a user information.

According to an embodiment of the invention, the driver IC includes a panel driving unit, a source driving unit, and a driver IC controller. The panel driving unit provides a plurality of horizontal clock signals for controlling the conducting states of the switches on the pixel panel. The source driving unit provides a plurality of data signals to the data lines. When the switches are turned on, the data signals are written into the corresponding pixels so that the pixel panel displays an image frame corresponding to the data signals. The driver IC controller respectively provides a switch switching signal and a polarity switching signal to the panel driving unit and the source driving unit according to the programmable burning code to drive the pixel panel.

According to an embodiment of the invention, the driver IC controller includes a multi-time programmable (MTP) memory. The programmable burning code is burnt into the MTP memory.

According to an embodiment of the invention, the panel driving unit switches the turn-on sequence of the switches according to the switch switching signal so that the switches are turned on in a first turn-on sequence or a second turn-on sequence.

According to an embodiment of the invention, the source driving unit includes at least one group of data channels for providing the data signals to the corresponding data lines.

According to an embodiment of the invention, the data channels include a positive-polarity data channel and a negative-polarity data channel. The data channels control the data signals to be output from the positive-polarity data channel or the negative-polarity data channel to the corresponding data lines according to the polarity switching signal.

According to an embodiment of the invention, the source driving unit drives the pixel panel through a line inversion technique or a dot inversion technique.

According to an embodiment of the invention, the driver IC includes a power supply unit for supplying power to the pixel panel.

According to an embodiment of the invention, the pixel panel is a low-temperature polysilicon (LTPS) panel.

The invention provides a panel driving method suitable for a panel driving system. The panel driving method includes following steps. A programmable burning code is burnt into a driver IC according to a user information. A pixel panel is driven according to the programmable burning code.

According to an embodiment of the invention, the pixel panel includes a plurality of data lines and a plurality of pixels, wherein each of the data lines includes a switch. The step of driving the pixel panel includes following steps. A plurality of horizontal clock signals is provided to control the conducting states of the switches on the pixel panel. A plurality of data signals is provided to the data lines. When the switches are turned on, the data signals are written into the corresponding pixels so that the pixel panel displays an image frame corresponding to the data signals.

According to an embodiment of the invention, the driver IC includes a panel driving unit and a source driving unit. The step of driving the pixel panel further includes following steps. A switch switching signal and a polarity switching signal are respectively provided to the panel driving unit and the source driving unit according to the programmable burning code to drive the pixel panel.

According to an embodiment of the invention, the step of driving the pixel panel further includes following steps. The turn-on sequence of the switches is switched according to the switch switching signal so that the switches are turned on in a first turn-on sequence or a second turn-on sequence.

According to an embodiment of the invention, the step of driving the pixel panel further includes following steps. The polarities of the data signals are switched according to the polarity switching signal to output the data signals to the corresponding data lines.

According to an embodiment of the invention, the driver IC includes a MTP memory. In the step of burning the programmable burning code into the driver IC, the programmable burning code is burnt into the MTP memory.

According to an embodiment of the invention, in the step of driving the pixel panel, the pixel panel is driven through a line inversion technique or a dot inversion technique.

As described above, in an embodiment of the invention, a panel driving system and a driver IC thereof can adaptively adjust its driving signals to satisfy user requirements according to a programmable burning code. Thereby, when the specification of a pixel panel is changed, the panel driving system and the driver IC thereof can completely support all possible panel structure combinations through a one-time design.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 4 illustrates pixel panels driven through different inversion techniques.

DESCRIPTION OF THE EMBODIMENTS

Figure 1:
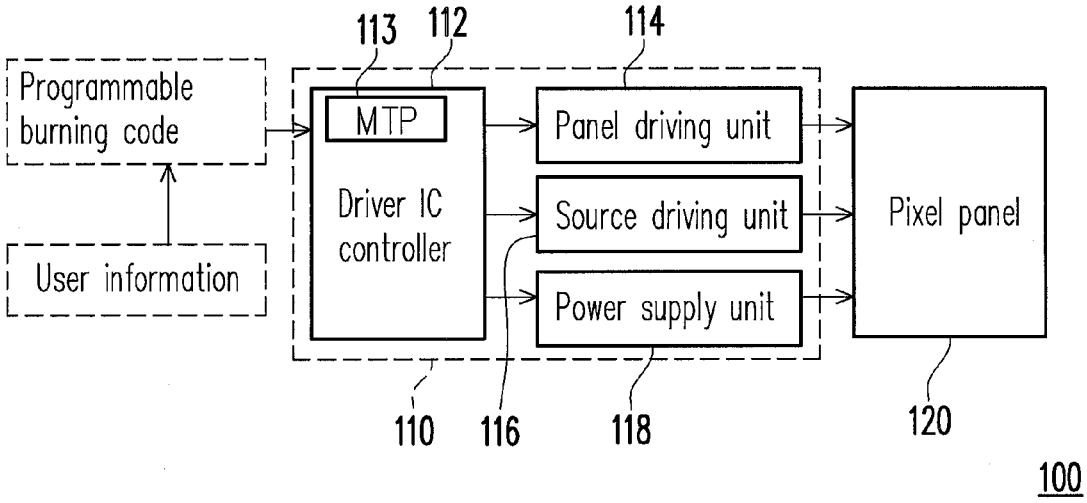
FIG. 1 is a block diagram of a panel driving system according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a block diagram of a panel driving system according to an embodiment of the invention. Referring to FIG. 1, in the present embodiment, the panel driving system 100 includes a pixel panel 120 and a driver IC 110. The pixel panel 120 may be a panel fabricated through the low-temperature polysilicon (LTPS) process (i.e., a LTPS panel).

In the present embodiment, the driver IC 110 includes a driver IC controller 112, a panel driving unit 114, a source driving unit 116, and a power supply unit 118. The driver IC controller 112 includes a multi-time programmable (MTP) memory 113.

To be specific, the driver IC controller 112 respectively provides a plurality of control signals to the panel driving unit 114, the source driving unit 116, and the power supply unit 118 according to a programmable burning code burnt in the MTP memory 113, so that the panel driving unit 114, the source driving unit 116, and the power supply unit 118 can drive the pixel panel 120 according to the corresponding control signals. For example, under the control of the driver IC controller 112, the panel driving unit 114 outputs a plurality of horizontal clock signals to drive the pixel panel 120, and the source driving unit 116 provides a plurality of data signals to the pixel panel 120 to write the data signals into the corresponding pixels on the pixel panel 120. Besides, the power supply unit 118 supplies power to the pixel panel 120.

It should be noted that in the present embodiment, the programmable burning code burnt in the MTP memory 113 is corresponding to a specific user information. Namely, through the control of the driver IC controller 112, the driving signals provided by the panel driving unit 114, the source driving unit 116, and the power supply unit 118 drive the pixel panel 120 under the effect of the programmable burning code. Herein the driving signals may be horizontal clock signals, data signals, and power supply signals.

In other words, in the present embodiment, different programmable burning code can be burnt into the driver IC 110 according to different user information so that the pixel panel 120 of different specification can be driven and accordingly different user requirement can be satisfied. Thus, in the present embodiment, the driving behaviours of the panel driving unit 114 and the source driving unit 116 are changed through a programmable control manner so that all possible panel structure combinations can be completely supported through a one-time design when the specification of the pixel panel 120 changes.

Below, the operation of the panel driving system 100 will be described with reference to several exemplary embodiments of the invention.

Figure 2:
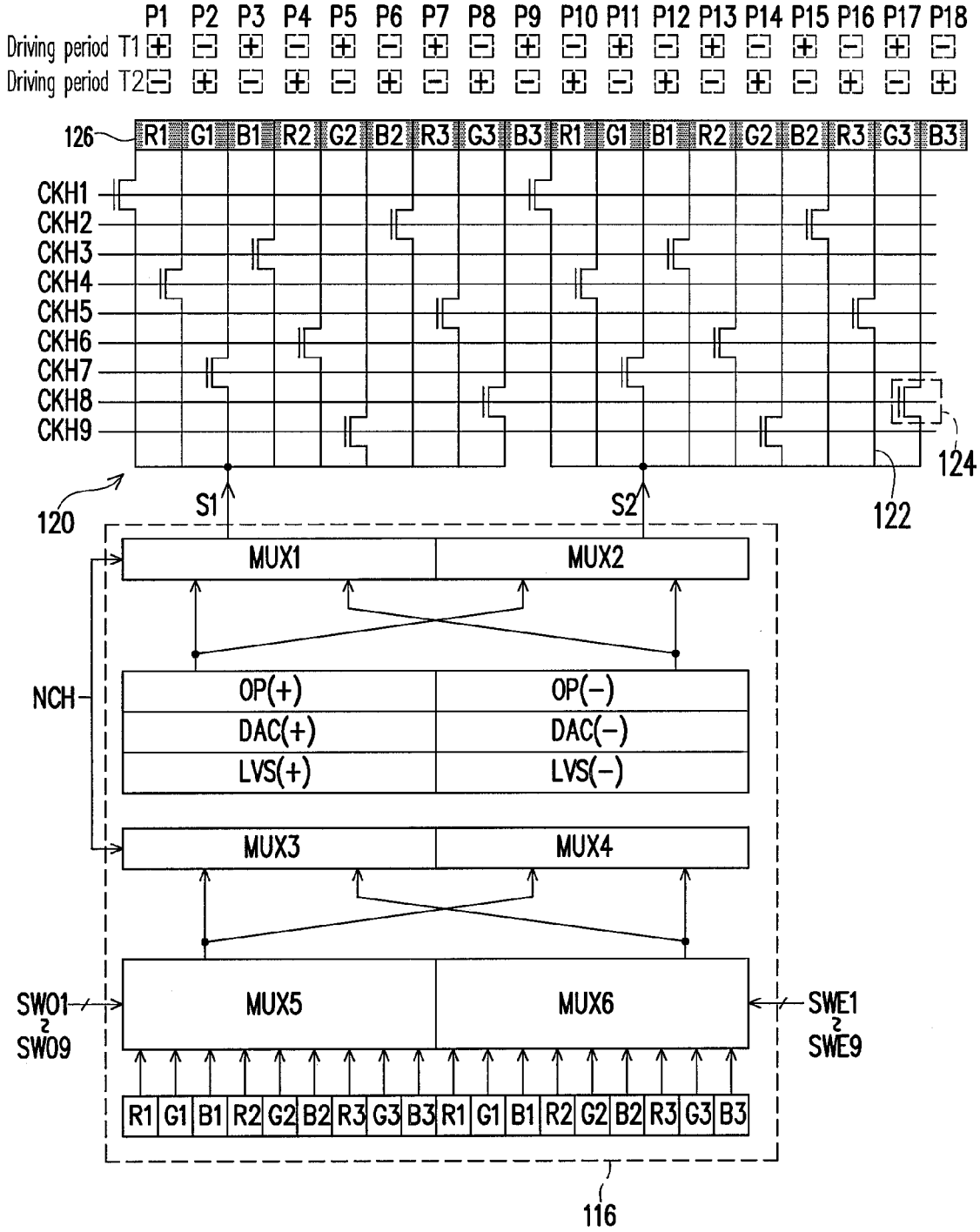
FIG. 2 is a diagram illustrating the implementations of a pixel panel and a source driving unit in FIG. 1.

FIG. 2 is a diagram illustrating the implementations of the pixel panel 120 and the source driving unit 116 in FIG. 1. For the convenience of description, only parts of the pixel panel 120 and the source driving unit 116 are illustrated in FIG. 2. For example, only some data lines and some pixels of the pixel panel 120 and one group of data channels of the source driving unit 116 are illustrated in FIG. 2.

Referring to FIG. 1 and FIG. 2, in the present embodiment, the pixel panel 120 includes a plurality of data lines 122 and a plurality of pixels P1-P18, wherein each of the data lines 122 includes a switch 124. Herein the conducting states of the switches 124 are controlled by the horizontal clock signals CKH1-CKH9 provided by the panel driving unit 114. In FIG. 2, the symbol "+" of a pixel indicates that the polarity of the pixel is positive, and the symbol "−" indicates that the polarity of the pixel is negative. For example, when the horizontal clock signal CKH9 is at a high level, the switches 124 corresponding to the color B2 on the color filter 126 are turned on, and accordingly the data signals S1 and S2 from the source driving unit 116 are respectively written into the pixels P6 and P15 corresponding to the color B2.

It should be noted that different pixel panel 120 has different coupling between the switches 124 and the color filter 126. In the present embodiment, every nine switches 124 are sequentially coupled to the colors R1, G1, B1, . . . , R3, G3, and B3 of the color filter 126, and the data lines coupled to these switches receive the data signal S1 from the source driving unit 116, as shown in FIG. 2. Similarly, the data lines coupled to another nine switches receive the data signal S2 from the source driving unit 116. However, the invention is not limited thereto.

On the other hand, in the present embodiment, only one group of data channels of the source driving unit 116 is illustrated in FIG. 2, and the data signals S1 and S2 are provided to the corresponding data lines 122 according to a polarity selection signal NCH and data selection signals SWO1-SWO9 and SWE1-SWE9. Herein a group of data channels include a positive-polarity data channel and a negative-polarity data channel.

To be specific, taking a positive-polarity data channel as an example, the multiplexer MUX5 is a 9-to-1 multiplexer, and which selects and outputs the corresponding data signal according to the data selection signals SWO1-SWO9. For example, when the data selection signal SWO5 is received, the multiplexer MUX5 outputs the data signal corresponding to the color G2. Then, if the polarity selection signal NCH is at a high level, the multiplexer MUX3 receives the data signal output by the multiplexer MUX5. Next, the data signal is sequentially processed by a level shifter LVS(+), a digital-to-analog converter DAC(+) and an output buffer OP(+) of the positive-polarity data channel to become a data signal with positive polarity. After that, the multiplexer MUX1 receives the data signal with positive polarity according to the high-level polarity selection signal NCH and outputs it to the corresponding data line 122 on the pixel panel 120.

Namely, in the present example, the panel driving unit 114 and the source driving unit 116 drive the pixel panel 120 through the data selection signal SWO5, the polarity selection signal NCH, and the horizontal clock signal CKH9, so as to write the data signal with positive polarity S1 corresponding to the color G2 into the pixel P5 during a driving period T1.

Meanwhile, the panel driving unit 114 and the source driving unit 116 may also drive the pixel panel 120 through the data selection signal SWE5, the polarity selection signal NCH, and the horizontal clock signal CKH9, so as to write the data signal with negative polarity S2 corresponding to the color G2 into the pixel P14 through a negative-polarity data channel during the driving period T1.

Next, during a driving period T2, when the polarity selection signal NCH switches to a low level, the multiplexer MUX4 receives a data signal output by the multiplexer MUX5, and the multiplexer MUX1 receives the data signal processed by a level shifter LVS(−), a digital-to-analog converter DAC(−), and an output buffer OP(−) of the negative-polarity data channel. Thus, during the driving period T2, the multiplexer MUX1 writes the data signal with negative polarity S1 corresponding to the color G2 into the pixel P5.

Contrarily, during the driving period T2, when the polarity selection signal NCH switches to the low level, the multiplexer MUX3 receives a data signal output by the multiplexer MUX6, and the multiplexer MUX2 receives the data signal processed by the level shifter LVS(+), the digital-to-analog converter DAC(+), and the output buffer OP(+) of the positive-polarity data channel. Thus, during the driving period T2, the multiplexer MUX2 writes the data signal with positive polarity S2 corresponding to the color G2 into the pixel P14.

In the present embodiment, the multiplexers MUX3 and MUX4 receive the data signal output by the multiplexer MUX5 or MUX6 according to the level of the polarity selection signal NCH, and the multiplexers MUX1 and MUX2 also receive the data signal output by the output buffer OP(+) or OP(−) according to the level of the polarity selection signal NCH.

It should be noted that in order to ensure the accuracy of the data signal written into each pixel, the multiplexer MUX1 has to receive the data signal output by the output buffer OP(+) when the multiplexer MUX3 receives the data signal output by the multiplexer MUX5. The multiplexer MUX2 has to receive the data signal output by the output buffer OP(−) when the multiplexer MUX4 receives the data signal output by the multiplexer MUX6. Similarly, the multiplexer MUX1 has to receive the data signal output by the output buffer OP(−) when the multiplexer MUX4 receives the data signal output by the multiplexer MUX5. The multiplexer MUX2 has to receive the data signal output by the output buffer OP(+) when the multiplexer MUX3 receives the data signal output by the multiplexer MUX6.

The present embodiment is described by assuming that the corresponding switch 124 is turned on through the horizontal clock signal CKH9. During the driving periods T1 and T2, the data signals S1 and S2 can be written into the corresponding pixels through the same technique described above when the corresponding switches 124 are turned on through other horizontal clock signals CKH1-CKH8, which will not be described herein.

In the present embodiment, a line of pixels P1-P18 on the pixel panel 120 is taken as an example. According to the polarities of this line of pixels P1-P18 during the driving periods T1 and T2, the source driving unit 116 in the present embodiment drives the pixel panel 120 through a dot inversion technique to allow the pixel panel 120 to display an image frame corresponding to the data signals.

Additionally, because the data signals provided by the multiplexers MUX3 and MUX4 have a lower voltage level, the level shifter LVS(+) of the positive-polarity data channel raises the voltage level of the data signal provided by the multiplexer MUX3 and the level shifter LVS(−) of the negative-polarity data channel lowers the voltage level of the data signal provided by the multiplexer MUX4 when the dot inversion technique is adopted.

For example, if the voltage level of the data signal provided by the multiplexer MUX3 is 1.8V, the level shifter LVS(+) raises it to 6.5V, and if the voltage level of the data signal provided by the multiplexer MUX3 is 0V, the level shifter LVS(+) does not raise the voltage level of the data signal but keeps it at 0V.

On the other hand, if the voltage level of the data signal provided by the multiplexer MUX4 is 1.8V, the level shifter LVS(−) lowers it to 0V, and if the voltage level of the data signal provided by the multiplexer MUX3 is 0V, the level shifter LVS(−) lowers it to −6.5V.

In the present embodiment, the horizontal clock signals CKH1-CKH9 sequentially turn on the corresponding switches 124 and write the data signals S1 and S2 into the corresponding pixels according to a first turn-on sequence CKH9, CKH8, CKH7, CKH6, CKH5, CKH4, CKH3, CKH2, and CKH1.

In order to compensate the panel and even the turn-on time, in the present embodiment, the horizontal clock signals CKH1-CKH9 may also turn on the corresponding switches 124 and write the data signals S1 and S2 into the corresponding pixels according to a second turn-on sequence CKH1, CKH2, CKH3, CKH4, CKH5, CKH6, CKH7, CKH8, and CKH9.

In the present embodiment, the driver IC controller 112 includes two registers (not shown) for storing the setting about the first turn-on sequence and the second turn-on sequence of the switches 124. It should be noted that the aforementioned first turn-on sequence and second turn-on sequence are only two exemplary embodiments but not intended to limit the invention.

Accordingly, the switches and the color filter are coupled together differently in different pixel panels. However, the driver IC 110 in the present embodiment satisfies user requirements by driving different pixel panels through the programmable horizontal clock signals CKH1-CKH9 and data selection signals SWO1-SWO9 and SWE1-SWE9.

In the present embodiment, the driver IC controller 112 provides two registers for storing the setting of the turn-on sequences of the switches. However, the driver IC controller 112 further includes another register (not shown) for storing the setting about the time point for switching the turn-on sequences.

For example, in the present embodiment, the switches 124 are sequentially turned on to write the corresponding data signals S1 and S2 according to the first turn-on sequence at each frame and each line of pixels.

Additionally, the switches 124 may also be sequentially turned on according to the first turn-on sequence at each odd frame and sequentially turned on according to the second turn-on sequence at each even frame regarding each line of pixels to write the corresponding data signals S1 and S2.

Moreover, the switches 124 may be sequentially turned on according to the turn-on sequence CKH1, CKH2, CKH3, CKH4, CKH5, CKH6, CKH7, CKH8, and CKH9 at a first odd frame, sequentially turned on according to the turn-on sequence CKH2, CKH3, CKH1, CKH5, CKH6, CKH4, CKH8, CKH9, and CKH7 at a second odd frame, sequentially turned on according to the turn-on sequence CKH3, CKH1, CKH2, CKH6, CKH4, CKH5, CKH9, CKH7, and CKH8 at a third odd frame, sequentially turned on according to the turn-on sequence CKH1, CKH2, CKH3, CKH4, CKH5, CKH6, CKH7, CKH8, and CKH9 at a first even frame, sequentially turned on according to the turn-on sequence CKH2, CKH3, CKH1, CKH5, CKH6, CKH4, CKH8, CKH9, and CKH7 at a second even frame, and sequentially turned on according to the turn-on sequence CKH3, CKH1, CKH2, CKH6, CKH4, CKH5, CKH9, CKH7, and CKH8 at a third even frame. In other words, the switches 124 are sequentially turned on according to different turn-on sequences during different frame periods to write the corresponding data signals S1 and S2.

Thus, the driver IC controller 112 further includes another register (not shown) for storing the setting about the number of frame periods or lines of pixels after which the turn-on sequence is switched. For example, in the present embodiment, the driver IC controller 112 outputs a switch switching signal Toggle_f (not shown) to the panel driving unit 114 determine after how many frames (for example, after one frame, two frames, or four frames) the turn-on sequence of the switches is toggled, and the driver IC controller 112 outputs a switch switching signal Toggle_1 (not shown) to the panel driving unit 114 to determine after how many lines (for example, after one line, two lines, four lines, and eight lines) of pixels the turn-on sequence of the switches are switched.

In the present embodiment, the source driving unit 116 drives the pixel panel 120 through a dot inversion technique. In another embodiment, the source driving unit 116 drives the pixel panel 120 through a line inversion technique to allow the pixel panel 120 to display an image frame corresponding to the data signals.

Figure 3:
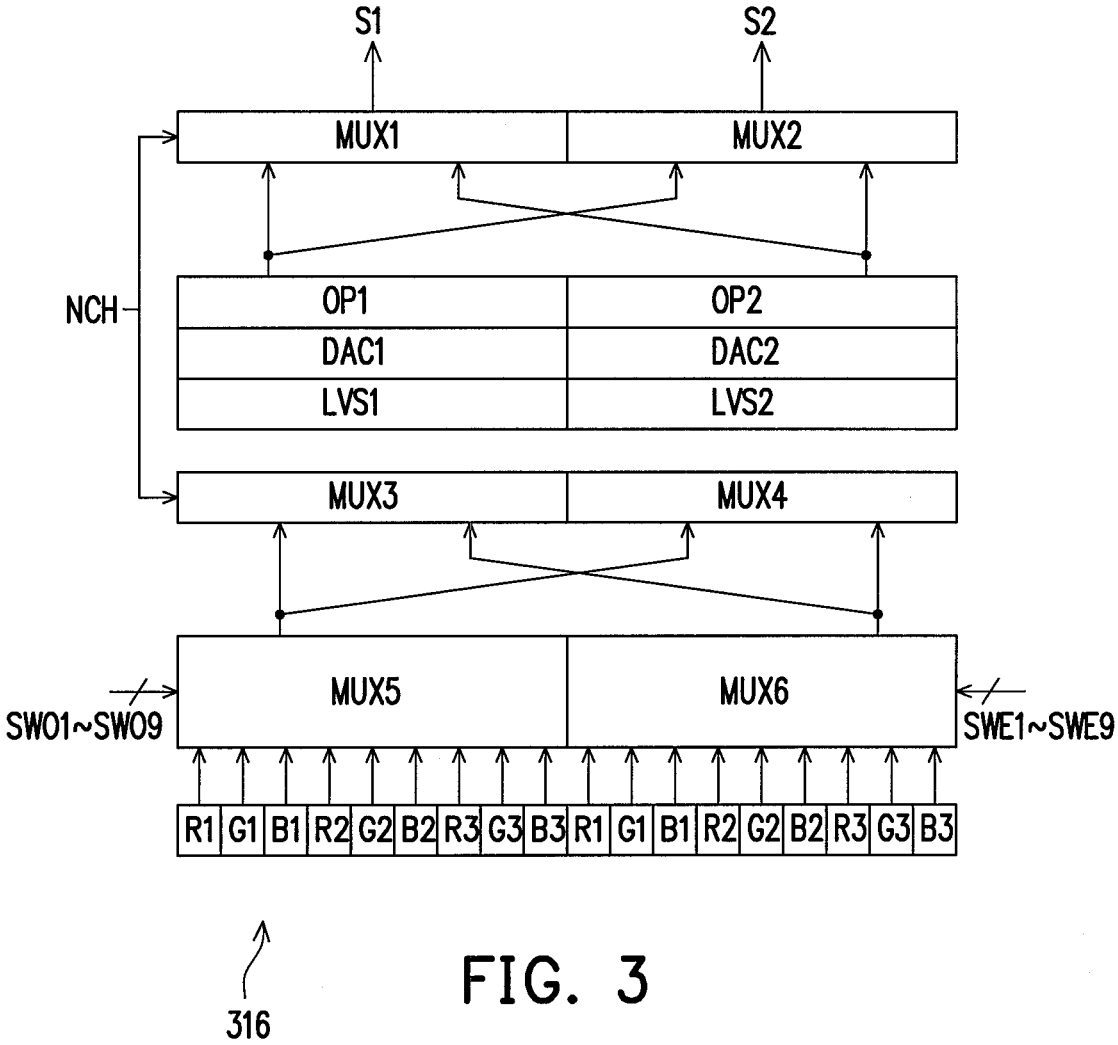
FIG. 3 is a diagram illustrating another implementation of the source driving unit in FIG. 1.

FIG. 3 is a diagram illustrating another implementation of the source driving unit in FIG. 1. For the convenience of description, only a part of the source driving unit is illustrated in FIG. 3. For example, only one group of data channels of the source driving unit is illustrated in FIG. 3.

In the present embodiment, the source driving unit 316 drives the pixel panel through line inversion. The major difference between the source driving unit 316 and the source driving unit 116 illustrated in FIG. 2 is that the data channels of the source driving unit 316 raise or lower the voltage levels of the data signals provided by the multiplexers MUX3 and MUX4 in a different way.

For example, if the voltage level of the data signal provided by the multiplexer MUX3 is 1.8V, the level shifter LVS1 raises it to 6.5V, and if the voltage level of the data signal provided by the multiplexer MUX3 is 0V, the level shifter LVS1 does not raise it but keeps the voltage level at 0V.

Similarly, if the voltage level of the data signal provided by the multiplexer MUX4 is 1.8V, the level shifter LVS2 also raises it to 6.5V, and if the voltage level of the data signal provided by the multiplexer MUX4 is 0V, the level shifter LVS2 does not raise it but keeps the voltage level at 0V.

Additionally, other aspects of the present embodiment that are the same as or similar to those in the embodiment illustrated in FIG. 2 can be referred to the description of the embodiment illustrated in FIG. 2 therefore will not be described herein.

FIG. 4 illustrates pixel panels driven through different inversion techniques. In FIG. 4, the symbol "+" indicates that the polarity of the pixel is positive, and the symbol "−" indicates that the polarity of the pixel is negative. Referring to FIG. 1, FIG. 2, and FIG. 4, in the present embodiment, a mechanism for controlling polarity switching flexibly is necessary if the driver IC 110 is about to drive different pixel panels having different inversion patterns (as shown in FIG. 4).

Thereby, in the present embodiment, the driver IC controller 112 includes a register (not shown) such that the driver IC controller 112 can control each multiplexer of the source driving unit 116. When each multiplexer works, the driver IC controller 112 outputs a plurality of control signals en1_muxg2[0]-en1_muxg2[7] (not shown) to the source driving unit 116 to determine when the polarity selection signal NCH is in transient and accordingly whether the polarity of the data signals should be changed. Accordingly, the driver IC controller 112 can adaptively drive pixel panels having different inversion patterns through corresponding driving techniques.

In addition, how the driver IC controller 112 drives a pixel panel can be determined after the turn-on sequence (i.e., the timings of the horizontal clock signals CKH1-CKH9) of the switches and the inversion pattern of the pixel panel are determined.

In another embodiment, the polarity switching of the data signals can be accomplished simply through the timing switching of the horizontal clock signals CKH1-CKH9. Thus, the polarity selection signal NCH is not inverted when the timings of the horizontal clock signals CKH1-CKH9 are switched. Whether the polarity selection signal NCH is to be inverted again can be determined after the timings of the horizontal clock signals CKH1-CKH9 are determined.

Additionally, other aspects of the present embodiment that are the same as or similar to those in the embodiment illustrated in FIG. 1 can be referred to the description of the embodiment illustrated in FIG. 1 therefore will not be described herein.

Figure 5:
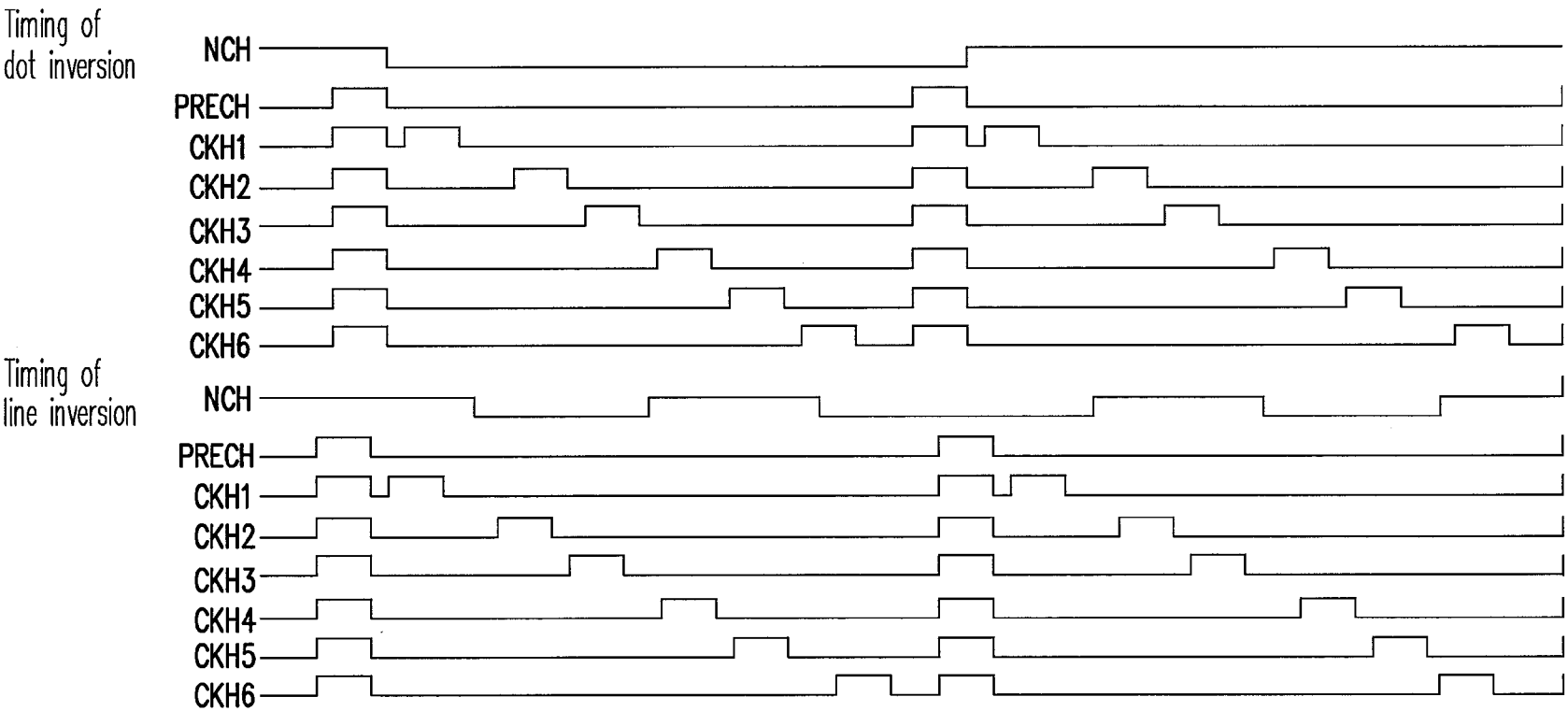
FIG. 5 illustrates the timings of various driving signals in a pixel panel respectively driven through a dot inversion technique and a line inversion technique.

FIG. 5 illustrates the timings of various driving signals in a pixel panel respectively driven through a dot inversion technique and a line inversion technique. The driving signal PRECH in FIG. 5 is used for pre-charging the data lines of the pixel panel. Referring to FIG. 1, FIG. 2, and FIG. 5, in the present embodiment, the driver IC controller 112 of the driver IC 110 may also adopt the timing control of both dot inversion and line inversion. It should be noted that the polarity selection signal NCH is switched more frequently in the dot inversion control than in the line inversion.

Additionally, other aspects of the present embodiment that are the same as or similar to those in the embodiment illustrated in FIG. 1 can be referred to the description of the embodiment illustrated in FIG. 1 therefore will not be described herein.

Figure 6:
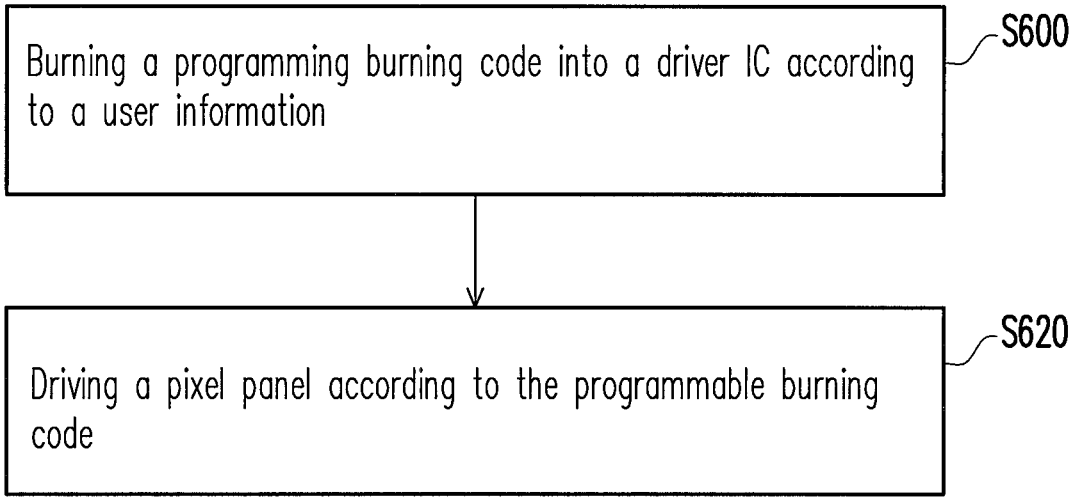
FIG. 6 is a flowchart of a panel driving method according to an embodiment of the invention.

FIG. 6 is a flowchart of a panel driving method according to an embodiment of the invention. Referring to both FIG. 1 and FIG. 6, in the present embodiment, the panel driving method is adaptable to the panel driving system in FIG. 1. The panel driving method in the present embodiment includes following steps. In step S600, a programmable burning code is burnt into the driver IC 100 according to a user information. Then, in step S602, a pixel panel is driven according to the programmable burning code.

Additionally, other aspects of the panel driving method in the present embodiment can be referred to the descriptions of the embodiments illustrated in FIGS. 1-5 therefore will not be described herein.

In summary, a panel driving system and a driver IC thereof are provided by embodiments of the invention, wherein driving signals in the panel driving system can be adaptively adjusted to satisfy user requirements according to a programmable burning code, so that when the specification of the panel is changed, the panel driving system and the driver IC thereof can completely support all possible panel structure combinations through a one-time design.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A panel driving system, comprising:

a pixel panel comprising a plurality of data lines and a plurality of pixels, wherein each of the data lines comprises a switch; and a driver IC driving the pixel panel according to a programmable burning code, wherein the programmable burning code is burnt into the driver IC according to a user information, wherein the driver IC comprises:

a panel driving unit providing a plurality of horizontal clock signals to control conducting states of the switches on the pixel panel;

a source driving unit providing a plurality of data signals to the data lines, the source driving unit comprises at least one group of data channels providing the data signals to the corresponding data lines, and the group of data channels comprises a positive-polarity data channel and a negative-polarity data channel, wherein when the switches are turned on, the data signals are written into the corresponding pixels so that the pixel panel displays an image frame corresponding to the data signals; and a driver IC controller respectively providing a switch switching signal and a polarity switching signal to the panel driving unit and the source driving unit according to the programmable burning code to drive the pixel panel, where the driver IC controller further determines a number of frame periods or lines of the pixels for switching a turn-on sequence of the switches, wherein the turn-on sequence is varied by the panel driving unit according to the switch switching signal, such that the data signals are written to the pixels according to the different turn-on sequences during different frame periods, and the group of data channels controls the data signals to be output from the positive-polarity data channel or the negative-polarity data channel to the corresponding data lines according to the polarity switching signal.

2. The panel driving system according to claim 1, wherein the driver IC controller comprises a multi-time programmable (MTP) memory, and the programmable burning code is burnt into the MTP memory.

3. The panel driving system according to claim 1, wherein the panel driving unit switches the turn-on sequence of the switches according to the switch switching signal so that the switches are turned on in a first turn-on sequence or a second turn-on sequence.

4. The panel driving system according to claim 1, wherein the source driving unit drives the pixel panel through a line inversion technique or a dot inversion technique.

5. The panel driving system according to claim 1, wherein the driver IC comprises a power supply unit supplying a power to the pixel panel.

6. The panel driving system according to claim 1, wherein the pixel panel is a low-temperature polysilicon (LTPS) panel.

7. A driver IC, suitable for driving a pixel panel, wherein the pixel panel comprises a plurality of data lines and a plurality of pixels, and each of the data lines comprises a switch, the driver IC comprising:

a panel driving unit providing a plurality of horizontal clock signals to control conducting states of the switches on the pixel panel;

a source driving unit providing a plurality of data signals to the data lines, the source driving unit comprises at least one group of data channels providing the data signals to the corresponding data lines, and the group of data channels comprises a positive-polarity data channel and a negative-polarity data channel, wherein when the switches are turned on, the data signals are written into the corresponding pixels so that the pixel panel displays an image frame corresponding to the data signals; and a driver IC controller respectively providing a switch switching signal and a polarity switching signal to the panel driving unit and the source driving unit according to a programmable burning code to drive the pixel panel, where the driver IC controller further determines a number of frame periods or lines of the pixels for switching a turn-on sequence of the switches, wherein the programmable burning code is burnt into the driver IC controller according to a user information, the turn-on sequence is varied by the panel driving unit according to the switch switching signal, such that the data signals are written to the pixels according to the different turn-on sequences during different frame periods, and the group of data channels controls the data signals to be output from the positive-polarity data channel or the negative-polarity data channel to the corresponding data lines according to the polarity switching signal.

8. The driver IC according to claim 7, wherein the driver IC controller comprises a multi-time programmable (MTP) memory, and the programmable burning code is burnt into the MTP memory.

9. The driver IC according to claim 7, wherein the panel driving unit switches the turn-on sequence of the switches according to the switch switching signal so that the switches are turned on in a first turn-on sequence or a second turn-on sequence.

10. The driver IC according to claim 7, wherein the source driving unit drives the pixel panel through a line inversion technique or a dot inversion technique.

11. The driver IC according to claim 7, wherein the driver IC comprises a power supply unit supplying a power to the pixel panel.

12. The driver IC according to claim 7, wherein the pixel panel is a low-temperature polysilicon (LTPS) panel.

13. A panel driving method, suitable for a panel driving system, wherein the panel driving system comprises a pixel panel and a driver IC, the panel driving method comprising:

burning a programmable burning code into the driver IC according to a user information; and driving the pixel panel according to the programmable burning code, wherein the pixel panel comprises a plurality of data lines and a plurality of pixels, each of the data lines comprises a switch, and the driver IC comprises a panel driving unit and a source driving unit, the source driving unit comprises at least one group of data channels, and the group of data channels comprises a positive-polarity data channel and a negative-polarity data channel, the step of driving the pixel panel comprises:

providing a plurality of horizontal clock signals to control conducting states of the switches on the pixel panel;

providing a plurality of data signals to the data lines, wherein when the switches are turned on, the data signals are written into the corresponding pixels so that the pixel panel displays an image frame corresponding to the data signals; and respectively providing a switch switching signal and a polarity switching signal to the panel driving unit and the source driving unit according to the programmable burning code to drive the pixel panel, where a number of frame periods or lines of the pixels for switching a turn-on sequence of the switches is also determined;

wherein the turn-on sequence is varied by the panel driving unit according to the switch switching signal, such that the data signals are written to the pixels according to the different turn-on sequences during different frame periods, and the group of data channels controls the data signals to be output from the positive-polarity data channel or the negative-polarity data channel to the corresponding data lines according to the polarity switching signal.

14. The panel driving method according to claim 13, wherein the driver IC comprises a multi-time programmable (MTP) memory, and in the step of burning the programmable burning code into the driver IC, the programmable burning code is burnt into the MTP memory.

15. The panel driving method according to claim 13, wherein in the step of driving the pixel panel, the pixel panel is driven through a line inversion technique or a dot inversion technique.

16. The panel driving method according to claim 13, wherein the pixel panel is a low-temperature polysilicon (LTPS) panel.

17. The panel driving method according to claim 13, wherein the step of driving the pixel panel further comprises:

switching the turn-on sequence of the switches according to the switch switching signal so that the switches are turned on in a first turn-on sequence or a second turn-on sequence.

18. The panel driving method according to claim 17, wherein the step of driving the pixel panel further comprises:

switching polarities of the data signals according to the polarity switching signal to output the data signals to the corresponding data lines.

* * * * *